United States Patent [19]

Croft

[11] 4,047,946

[45] Sept. 13, 1977

[54] DUPLICATING PROCESS UTILIZING ION MODULATING MEANS AS THE IMAGE GENERATING SOURCE

[75] Inventor: George Thomas Croft, Northfield, Ohio

[73] Assignee: Addressograph Multigraph Corporation, Cleveland, Ohio

[21] Appl. No.: 654,611

[22] Filed: Feb. 2, 1976

Related U.S. Application Data

[62] Division of Ser. No. 492,005, July 26, 1974, Pat. No. 3,957,365.

[51] Int. Cl.[2] ..... G03G 13/22

[52] U.S. Cl. ..... 96/1 R; 96/1.4; 355/3 R

[58] Field of Search ..... 355/3 SC, 3 TR; 96/1.5, 96/1 R, 1.4

[56] References Cited

U.S. PATENT DOCUMENTS

| | | | |
|---|---|---|---|
| 3,591,276 | 7/1971 | Byrne | 355/3 TR |
| 3,811,765 | 5/1974 | Blake | 355/3 SC |
| 3,893,761 | 7/1975 | Buchan et al. | 355/3 TR |
| 3,955,530 | 5/1976 | Knechtel | 355/3 TR |
| 3,994,726 | 11/1976 | Wales | 96/1.5 |

FOREIGN PATENT DOCUMENTS

| | | | |
|---|---|---|---|
| 763,900 | 7/1967 | Canada | 96/1.5 |

*Primary Examiner*—L. T. Hix

*Assistant Examiner*—J. A. LaBarre

*Attorney, Agent, or Firm*—Sol L. Goldstein

[57] ABSTRACT

An ion modulator such as a three-layered structure, formed by sandwiching a photoconductor between a metal screen and an insulating layer, which is used as an image source. The apparatus includes an optical system for projecting an image of a graphic original onto the modulator and creating a charge distribution system thereon that can be retained for long periods of time. As part of the apparatus there is included a special drum formed by adhering a resilient-rubber like layer having a compliance that produces a displacement from the normal surface in the range of 1/16 to 3/32 inch when placed under 25 - 75 pounds of force per lineal inch, and a thickness of about 0.60 inches. Over the compliant layer is next applied an insulating or dielectric layer having a resistivity of at least $10^{14}$ ohm-centimeters and a thickness of about 0.5 mils. The special drum, which is the image generating medium, receives the charge pattern resulting from collecting the ion particles on the dielectric layer. The charge pattern is developed and the transferrable images produced thereon are transferred to plain paper under the condition where the resiliency of the image generating medium is responsible for producing images of high integrity. Various types of reproductions can be made on plain paper such as ink images or toner powder images fused onto the impression paper.

5 Claims, 4 Drawing Figures

DUPLICATING PROCESS UTILIZING ION MODULATING MEANS AS THE IMAGE GENERATING SOURCE

This is a continuation, division, of application Ser. No. 492,005 filed July 26, 1974, now U.S. Pat. No. 3,957,365.

BACKGROUND OF THE INVENTION

This invention is generally directed to duplicating equipment of the type in which a transferable image is received on plain paper, and more particularly, relates to the use of ion modulating devices in combination with the various instrumentalities used in duplicating systems to produce a multifarious duplicator.

In the duplicator art, there are several known systems whereby a reproduction is produced on plain paper by transferring a material image from an image generating medium in a cyclic fashion so that a given processing cycle is repeated many times until the number of desired reproductions is completed.

One of the most well known of such duplicating systems is the lithographics duplicating process in which the image generating medium is a lithographic or planographic master which is differentially receptive to water and oil base inks. The lithographic master is required to be prepared as a separate step by either writing directly on the master or by photographic techniques in the circumstance that the master is light sensitive. As is well known, the lithographic process calls for applying to the cylinder mounted master both ink and water resulting in an ink or material image which is then transferred to a blanket cylinder which, in turn, is pressed against a sheet of impression paper to produce the final reproduction.

Another well-known duplicating system involves electrostatic reproduction techniques in which the image generating medium is a drum or cylinder on which has been applied a light-sensitive photoconductive layer which becomes imageable by well-known electrostatic reproduction techniques. Accordingly, a pattern of light and shadow is projected onto the light sensitive photoconductive drum which is then developed by the application of electroscopic powder. The electroscopic powder is transferred to plain paper, and again, there results a duplicating system whereby multiple copies may be made of a graphic original.

Derivative systems of the above described duplicating systems are known that employ these basic techniques in special ways. For example, in lithographic duplicating there is available direct lithography avoiding the use of the intermediate blanket on which the transferable image is created. In the electrophotographic systems, several variations are known which utilize the basic concept. One such system goes through a complete imaging cycle for each copy requiring charging, exposure, developing, transfer and cleaning. Another variation avoids most of these steps and utilizes a latent image reproduction in which one latent image is developed after each transfer. Still another system calls for fusing the powder image on the photoconductive layer so that it serves as the base on which is attracted the electroscopic powder on subsequent developing cycles, avoiding the photographic imaging of the photoconductive medium.

In the electrophotographic art, such duplicating systems may use replaceable photoconductive sheets so that at the end of a given cycle, the photoconductive medium may be renewed by using a new master as the electrophotographic image generating medium.

All of the aforedescribed duplicating systems have enjoyed significant commercial success but not without certain advantages. The main cause of such disadvantages resides in the preparation of the image generating medium. In the case of the lithographic master, it requires special preparation, using either the photographic techniques or direct imaging. In either case it requires special handling in development of the master so that it is differentially receptive to water and ink. In the case of electrophotographic systems, the photoconductive medium requires frequent replacement because these materials are fragile and are easily scratched or damaged in the normal course of usage.

There is a need in the duplicating art for a multifarious system in which there is a universal type image generating medium, hereinafter referred to as IGM, that can be utilized interchangeably with the electrophotograpic techniques or the lithographic systems.

SUMMARY OF THE INVENTION

The apparatus of this invention combines the image-producing capabilities of an ion modulating device which is in optical communication with an optics system together with the necessary image producing instrumentalities to provide a new and highly efficient duplicating system. Ion modulating devices, as used in this invention, comprise an apertured or foraminated conductive structure, such as a screen, over which is applied a photoconductive layer. Such a two-layered structure is a basic form of ion modulator. Other constructions and combinations are possible, such as using a third insulating layer in accordance with the inventions described in U.S. Pat. applications Ser. Nos. 423,883 and 423,884, filed in the name of John D. Blades and Jerome E. Jackson and assigned to the same assignee of this invention, provide a wide range of capabilities.

The ion modulator, as a photoconductive screen, responds in much the same way as conventional photoconductive media in that the photoconductive layer can be charged, thereby rendering it sensitive to electromagnetic radiation and thereafter exposed to a pattern of light and shadow to create an electrostatic charge pattern thereon. Such ion modulators or aperture devices are, therefore, capable of accepting an electrostatic charge and will respond to a pattern of light and shadow in order to have recorded thereon an electrostatic charge distribution system which will serve to selectively transmit charged particles, such as gas ions, or colored toner particles. The particles which are not transmitted through or which are blocked, are either conducted to ground, or, in the case of a toner particle, would be collected on the screen.

Associated with an ion modulator is a charged particle collection medium onto which is collected the particles transmitted by the screen in conformance with the charge distribution system created thereon through the use of the conventional photographic imaging techniques. This is an important aspect of the instant invention in that the duplicating machine includes as the charged particle collection means, a drum having a dielectric layer thereon which possesses the necessary physical and mechanical property critical to image transfer, and at the same time functions as one of the electrodes in a system having a charge particle projection electrode.

The IGM of the instant invention is therefore a special drum having a suitably resilient layer possessing the necessary electrical properties so that it functions as a collection electrode to have deposited thereon a charge particle pattern corresponding to a graphic original to be reproduced through the use of an ion modulator which serves to record an electrostatic field pattern of the graphic intelligence carried on the original. Once an electrostatic charge pattern has been deposited on the IGM, the system lends itself to a number of different techniques whereby the charge image may be converted into a material image which can then be transferred to a sheet of plain paper. A series of processing stations are provided about the IGM, each station or group of stations being adapted to convert the charge image to a material image at the option of the machine operator.

One such station provides for the application of toner particles or electroscopic powders which are attracted to the charge areas on the drum thereby producing one form of a material image which can then be transferred to the plain paper at a transfer station, the latter station being particularly adpated to move the powder from the IGM to the surface of the paper.

Another station is provided at which the powder image may be heat fused onto the IGM in the circumstance that the length of run required is exceptionally long. Once the powder image has been fused onto the IGM, it becomes an electrostatically chargeable pattern when exposed to a corona discharge electrode to which is attracted toner. The newly attracted toner is then transferred at the transfer station. The fused image can be used in a lithographic duplicating mode accepting ink and water to the surface and thereby transfer the ink image to a sheet of plain paper at the transfer station.

Understandably, a feature of this invention provides for the convertibility of the IGM into a surface which is differentially receptive to ink and water.

Adjacent the IGM, there is positioned a lithographic duplicating station, made up of a train of ink and moisture rollers for applying these materials to the surface of the IGM. The transferable ink layer is deposited onto the image and is then transferred to plain paper.

Other stations are provided for cleaning the IGM so that it may be reused at the conclusion of any one of the electrostatic or lithographic imaging cycles. Provision is also made for replacing the surface of the IGM to provide a charge collecting surface which possesses the unique properties of rejecting the oleophilic ink in the non-image areas and thereby obviating the need for water. Such a surface is identified as having abhesive properties.

It is a general object of this invention to provide a greatly improved duplicator apparatus capable of carrying out multifarious reproduction systems.

It is a further object of this invention to provide an improved duplicating apparatus which utilizes an ion modulator in conjunction with an IGM capable of functioning as a charge collecting surface to collect the charges transmitted by the ion modulator creating a charge distribution system on said IGM which corresponds to the intelligence contained on a graphic original to be reproduced on plain paper employing different reproduction techniques.

It is a still further object of this invention to provide a duplicator for making reproductions of a graphic original on plain paper through the use of an ion modulator having a memory of long duration and through which are projected charged particles to be collected on an IGM in conformance to the intelligence on the graphic original having an extremely high rate of output and capable of making reproductions that are consistently high in quality obviating the need for the use of any master-making or master-handling steps.

It is a still further specific object of this invention to provide a duplicating apparatus capable of making reproductions on plain paper of the graphic intelligence contained on a graphic original through the use of an ion modulator on which is recorded the graphic intelligence in the form of a charge pattern which is capable of discriminating charged particles projected onto the screen and selectively transmitting the ions therethrough to create a charge pattern on an IGM in conformance with the graphic intelligence, which charge pattern may thereafter be converted into a material image for use with lithographic or electrostatic reproduction techniques to produce copies on plain paper at a very high rate of output without the requirement of a separate master or master-preparing processes.

It is a still further specific object of this invention to provide an improved duplicator having a greatly improved imaging system employing an ion modulator in cooperation with an optical system for producing a charge distribution system on said ion modulator which may then be used as part of an electrode system in which a charge emission electrode is employed for projecting charge particles onto said ion modulator which selectively transmits the charged particles in conformance with the intelligence contained on the graphic original and then collecting said transmitted particles onto a collection electrode, wherein said collection electrode is an IGM specially adapted to effect transfer of any material images therefrom with a minimum of perturbation of said material image during said transfer step.

It is a still further specific object of this invention to provide an image generating surface for use in a multifarious duplicator which is capable of functioning as a collection electrode in the environment of an ion modulator electrode system thereby accepting a charge pattern thereon and having utility in a reproduction system using an oleophilic ink and having the further capability of rejecting said oleophilic ink from the non-image portions thereby obviating the requirement of moisture in the system.

Other objects and advantages of the multifarious duplicator of this invention will become apparent from the following detailed description:

BREIF DESCRIPTION OF THE DRAWINGS

DETAILED DESCRIPTION

DESCRIPTION OF THE PREFERRED EMBODIMENT

Figure 1:
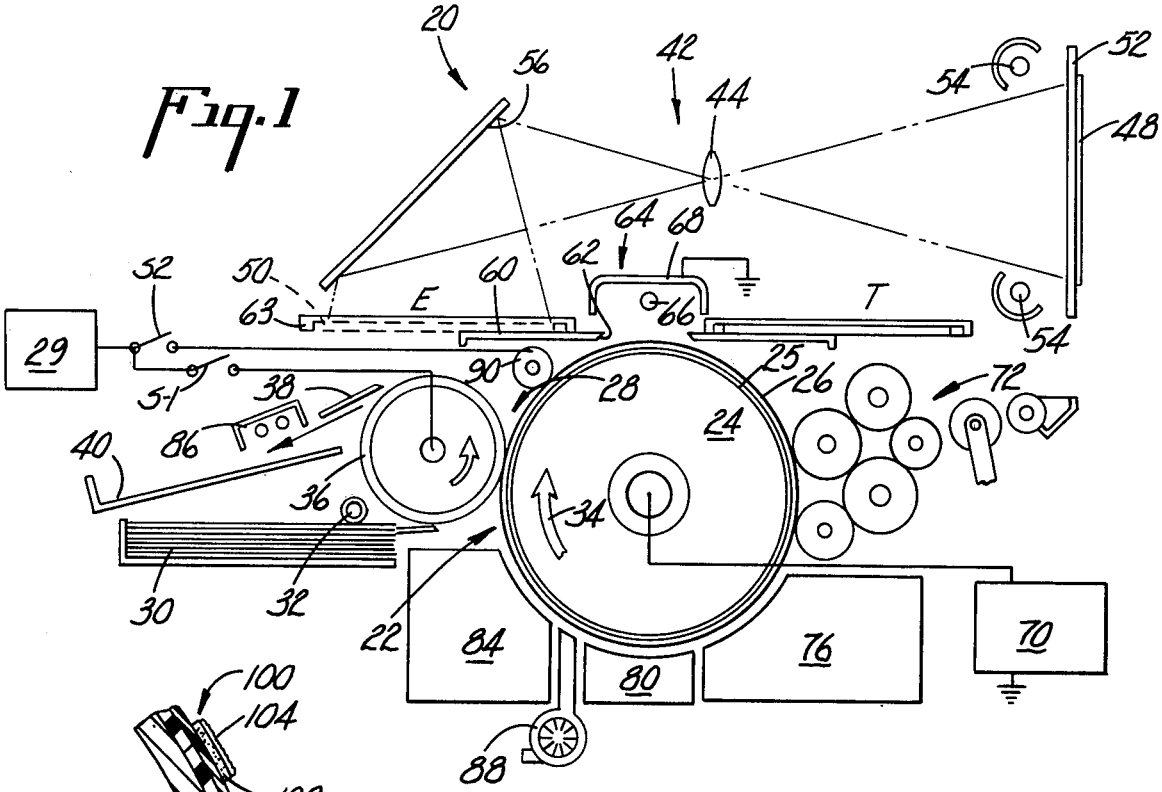
FIG. 1 is a schematic representation of the multifarious duplicating apparatus of this invention.

Referring to FIG. 1 of the drawing, there is shown an apparatus identified generally as 20 made up of a number of instrumentalities which are combined in a manner to produce a multifarious duplicator of this invention and is deemed typical of such apparatus.

Central to the construction of the duplicator 20 is the image generating medium IGM 22 which is of a special construction to be discussed in greater detail hereinafter. The IGM is essentially a drum support 24 which is made of a conductive material such as extruded aluminum, cast iron or even molded brass so as to form a conductive base support. On the drum surface is first applied a resilient layer 25 which is then covered with a dielectric layer 26. The term "image generating medium" as used throughout this discussion is intended to mean the instrumentality in a multifarious duplicator which is capable of having produced thereon and transferred therefrom a material image to a receiving sheet at a transfer station 28. Adjacent to the IGM 22 and in cooperative association therewith is a supply stack of sheets of impression paper 30 equipped with a feeder wheel 32 in frictional contact with uppermost sheet in the stack. The friction wheel 32 is intermittently driven from the main drive source (not shown) so as to feed seriatim one sheet at a time from the stack to the transfer station 28. The IGM 22 is caused to rotate in the direction shown by the arrow 34 bringing the outer surface of the dielectric layer 26 in surface contact with an impression cylinder 36 which is in rolling contact with the IGM 22 comprising the transfer station 28 at their point of contact. The impression cylinder 36 is located at the outfeed of the stack of impression paper 30 so that as each sheet leaves the stack it is caused to enter the transfer station 28 between the impression cylinder 36 and the IGM 22. At the transfer station, the material image is transferred to the surface of the sheet of impression paper 30 which is then guided underneath the guide member 38 into the receiving tray 40.

Figure 4:
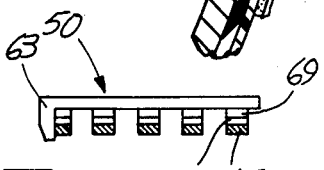
FIG. 4 is a schematic representation of a cross section of one type of a memory modulator.

An important feature of the multifarious duplicator of the instant invention resides in the technique whereby the graphic subject matter contained on a graphic original is reproduced as an electrostatic charge pattern on the dielectric layer 26 of the IGM 22. For this purpose, there is provided an electrostatic image assembly 42 which includes a lens system 44 placing in optical communication a graphic original 48 and a photoconductive gas ion modulator 50. The modulator 50 is of the type having memory capabilities whose structure includes a photoconductive layer 67 sandwiched between an insulating layer 69 and a metal screen 65 as shown schematically in FIG. 4. Other memory type constructions can be used to the same advantage. The graphic original 48 is placed against a transparent platen support 52, the face of the original is illuminated by electromagnetic radiation sources 54 producing a pattern of light and shadow corresponding to the graphic intelligence on the original. To complete the optical path, a highly reflective surface 56, such as a mirror, is disposed on one side of the lens 44, resulting in projecting the image onto the surface of the modulator 50.

As part of the optical imaging system is a platform 60 equipped with a longitudinal slot opening 62 which is co-extensive the length of the IGM 22. The platform 60 is itself stationary forming an apertured roof over the IGM 22 but is adapted to support the modulator 50 on a slidably mounted frame 63 in a manner that permits it to reciprocate between positions E and T. The modulator 50 is shown in FIG. 1 in dotted outline condition at the station E, at which it receives the projected image from the graphic original 48.

It will be appreciated that the procedures to be followed at the station E will depend on the construction and type of photoconductive gas ion modulator employed. The simpler constructions of gas ion modulators are well known. There have been recent advancements in this art such as the modulators described in U.S. Pat. application Ser. Nos. 423,883 and 423,884 filed in the name of Blades, et al., and assigned to the same assignee as the instant invention. While a number of ion modulators are known in the prior art, only those may be employd with the invention described herein which have a memory. The term memory as used in this description is intended to mean any photoconductive screen capable of retaining the image-wise blocking and transmission properties for periods of time that are sufficiently long to permit making at least the reproductions of the charge image on the IGM, either under conditions of controlled light or in oridinary room light.

It is necessary for modulators, to have utility in this invention, to retain the charge pattern imparted to the surface thereof by means of the various processing steps so that the projection of gas ions therethrough can proceed independently and does not require to simultaneously project gas ions and a pattern of light and shadow to maintain an image-wise pattern thereon. As shown in the instant invention, the modulator is given a full-frame exposure and is then caused to be carried past the slit opening 62 across the platform 60 from the exposure station E to the terminating station T.

Straddling the slit opening 62, there is projected co-extensive therewith and in a direction transverse to the path taken by the modulator 50 a source of gas ions 64 comprising a corona wire 66 partially surrounded by a grounded conductive shield 68. The IGM, turning in the direction of the arrow 34, moves in synchronism with the ion modulator 50 as it translates from station E to station T being transported across the slit opening 62. The modulator 50, having been processed in a manner to produce a charge pattern on its surface, will have a discriminating or modulating effect on the gas ions emitted from the wire 66 so as to cause the transmission of gas ions in those areas corresponding to the image portions on the graphic original which are then collected on the dielectric layer 26. The imaging procedure for projecting the gas ions through the modulator 50 in this manner results in depositing a charge pattern on the surface of the dielectric layer 26 of the IGM 22. The deposition of the charged particles onto the dielectric surface 26 is accomplished by connecting the conductive layer 24 to a high voltage source 70 thereby creating an electrical field between the layer 24 and the conductive screen. The source 70 applies a voltage in the range of 6,000 to 10,000 volts, providing a field strength between the modulator 50 and the conductive layer 24 in the range of 500 to 12,000 volts/centimeter. The emission electrode 64 is also connected to a high voltage source applying in the range of 3,500 to 13,000 volts, preferably in the range of about 8,000 volts to the corona electrode.

With the charge pattern produced on the surface of the dielectric layer 26, the image generating medium in its continued rotation, causes the image generating medium to move past the stations 72, 76, 80, and 84, whose functionalities are lithographic inking systems, toner powder fusing, electroscopic toner application and cleaning.

The functionalities, such as the ink system 72, the fusing system 76, the toning processing step 80 and the cleaning function 84 are controlled between an operating and non-operating condition in conformance with the cyclic movment of the IGM 22 so that the processing steps are carried out in a manner that results in producing thereon a material image which can be utilized with the desired reproduction technique.

As the IGM 22 completes a first rotational cycle receiving a charge pattern deposited thereon by projecting the gas ions through the modulator 50, it will proceed past the ink-applying station 72 and the fusing station 76 which are not operative, at part of the cycle, but the toning station 80 is operative applying to the dielectric layer 26, bearing a charge pattern thereon, electroscopic particles from the toning station 80. The transfer station at this point in the rotation of the IGM 22 is also rendered inoperative and the IGM 22 is caused to continue on its rotational path past the fusing station 76 which is now activated, causing the fixing of the thermoplastic particles to the layer 26 through melting of the powder. Completing this third cycle, the toning station 80 is rendered inoperative and as the IGM 22 proceeds into the fourth cycle, the inking station 72 is made operative and applies to the surface of the IGM 22 conventional lithographic ink which selectively adheres to the fused powder in the configuration of the graphic intelligence on the original.

An important feature of the invention is the dielectric layer 26. In the circumstance the dielectric layer 26, shown and described in FIG. 1, is specially treated it will not require the use of water as in conventional lithographic systems. The system 72 need only apply the oil-based ink. The dielectric layer 26 may be treated with ink-repellent materials such as polysiloxane compounds, such as disclosed in U.S. Pat. No. 3,728,123 and U.S. Pat. No. 3,511,178, which obviate the need of a moisture system to provide the differential receptivity of the background and the image area to ink. In other words, the background of the dielectric layer 26, which has been treated with the polysiloxane material, will reject the greasy inks and will selectively receive and attract the ink onto the fused powder image.

The IGM 22 will complete the fourth cycle, during which the transfer station 28 becomes operative, with the exception of applying the high voltage to the roller, so that the impression cylinder 36 is put into nipping contact with the IGM 22 in synchronization and in timed relation with the feeding of a sheet of impression paper from the stack 30 through the action of the feeder wheel 32. Accordingly, with each revolution of the IGM 22 carrying the image thereon, there is fed a sheet of paper from the stack 30 so that it is in position on the impression cylinder 36 to receive and have transferred to its surface the ink image and thence into the receiving tray 40. The foregoing is a description of the direct lithographic duplicating cycle in which the cleaning station 84 and the toning station 80 and the fusing station 76 are de-activated and the ink applying system 72 is rendered operative to selectively apply ink to the toner image and transfer it to the impression paper 30 with each revolution of the image generating medium 22. The reproduction cycle may continue until the desired number of reproductions are taken from the IGM. The number of reproductions that could be made parallels the performance of conventional lithographic duplicating machines so that large numbers of inked copies could be produced.

At the conclusion of the duplicating cycle, the ink roller system 72 is de-activated as is the transfer station 28 and the cleaning station 84 is rendered operative. The cleaning station will provide the usual and well-known application of a stoddard type solvent system to the surface in order to remove not only the ink but the fused toner composition as well. The use of such stoddard solvents normally used to remove lithographic inks and fused thermoplastic material will not affect the polysiloxane materials deposited on the surface which render it ink repellent. To assist in the cleaning operation, there is provided a force hot air source 88 which is activated at the conclusion of the cleaning cycle to evaporate any residual solvent from the surface of the IGM. Referring further to the apparatus 20 in FIG. 1, in still another mode of operation, the modulator 50 may be utilized as the master, in the sense that it provides the basic pattern from which an electrostatic charge pattern is deposited on the surface 26 of the IGM 22. In this mode of operation, the reproductions which are made on the impression paper 30 are formed by transferring the thermoplastic toner powder to the plain paper and thereafter passing it through a fixing or fusing station 86.

Tracing the operations as described hereinabove, the modulator 50 is imparted a charged distribution system so that it is capable of blocking certain of the gas ions emitted from the electrode 64 corresponding to the nonimage area on the graphic original while transmitting ions in those areas which correspond to the image portions.

During the first cycle of rotation of the IGM 22, the gas ion emission electrode 64 is energized, and the movement of the modulator 50 proceeds from the station E, across the opening 62 and in the direction of the station T. The movement of the modulator 50, as described hereinabove, is in synchronism with the rotation of the drum so that the emission of gas ions from the emission electrode 64 is uniformly deposited on the dielectric surface 26. During this first rotational cycle of the IGM 22 in the direction of the arrow 34 as shown in FIG. 1, the ink roller system 72, the fusing station 76, and the cleaning station 84 are inoperative, and only the toning station 80 is placed in operation. As the charge pattern-bearing surface 26 moves past the toning station, it is applied the electroscopic toner powder which adheres to the image areas which is then transferred to a sheet of plain paper 30 fed from the supply source by the action of the feeder wheel 32 so that the sheet of paper 30 arrives at the transfer station 28 at the appropriate time in order to have transferred thereto the powder image. The transfer roller 36 is connected to high voltage source 29 through the operation of the switch S-1 applying a voltage in the range of 300 to 3,000 volts. Upon emergence of the paper with the transferred powder image thereon from the transfer station 28, it is guided into the receiving tray 40 after being exposed to a fusing unit 86 which casts infra-red radiation onto the thermosplastic powder causing it to be fused onto the copy sheet.

On the next rotational cycle, the IGM 22, the cleaning unit 84 is energized to remove any untransferred dry powder. In the place of the solvent system, the cleaning unit may be any one of the conventional brush type systems which physically brush the loose toner powders from the surface which are then collected and returned to the toning unit for reuse. The various cleaning devices that may be employed for removing the dry untransferred toner particles from the surface of the dielectric layer 26 are well known in this art and include the use of air blow systems as well as various electrodes to attract the toner particle from the surface of the dielectric layer 26 into a suitable collecting medium. In the case of the brush cleaning unit, it may be formed of fibers which are triboelectrically selected so as to attract the toner particles from the surface of the dielectric layer 26 and thence to be collected for reuse.

As part of the cleaning cycle, there is provided a roller electrode 90 which is applied a voltage from the high voltage source 29 by the operation of switch S-2. By closing S-2, an appropriate field may be applied to the roller 90 so as to erase any unwanted residual charge on the layer 26.

During the ion projection cycle, the modulator 50 is moved across the opening 62 from the station E to station T. During the cleaning cycle, the modulator is caused to return to the station E where it comes to rest at the conclusion of the cleaning cycle and is now in readiness for beginning the gas ion projection step again repeating the printing cycle. In this mode of operation, it may be possible to eliminate the cleaning step in the circumstance that the transfer of the toner particles at the transfer station is complete, leaving small amounts of toner particles untransferred which would not interfere with the subsequent imaging step. One of the advantages of the instant invention resides in the construction of the IGM 22 which provides a resilient material which forms the dielectric surface 26 making possible the complete transfer and hence the production of high quality copies, not only when operating the apparatus in the ink transfer mode but in the mode wherein the dry toner powder is transferred to the plain paper.

Figure 2:
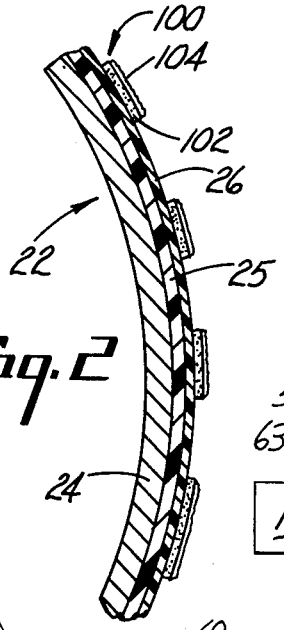
FIG. 2 is an enlarged detail of the IGM shown in cross section.

Referring now to FIG. 2, there is shown an enlarged cross section of the IGM 22 formed of the metallic or otherwise conductive shell 24, applied directly to the conductive shell 24 is a resilient rubber-like layer 25 having a thickness in the range of 0.055 inch to 0.075 inch, the preferred thickness being in the range of 0.060 to .065 inch. In determining the suitable compliancy for this layer, it has been found that when subjected to a force in the range of 25 lbs. to 75 lbs. per lineal contact inch, the compliant layer will be displaced or raised from its normal condition under the applied force exerted by a roller a distance in the range of 1/16 to 3/32 inch. When the force is removed, the layer returns to its normal condition. Suitable rubber materials that have operated successfully in the environment of the present invention are the following:

thiokol
nitrile
neoprene

A typical rubber layer that was used successfully is sold by Rapid Roller Company of Chicago, Ill.

All of the aforementioned rubber compounds can be doped with well known additives in order to produce the desirable conductivity.

In order to provide the critical dielectric properties to the IGM 22, a suitable, thin dielectric layer 26 must be applied to the resilient layer 25, thereby providing the dielectric surface.

The properties of the dielectric layer govern the quality of the reproduction which is ultimately produced on the impression paper 30. For example, the layer 26 must possess good mechanical wear-resistant properties and endure the repeated application of charges, ink, exposure to the fusing temperatures which result from the fusing station 76, the brushing action applied by the toning station 80 and the cleaning station 84 and finally the abrasion that occurs at the transfer station 28 when ultimately making the transfer of the material image to the impression paper 30. It is desirable that the surface withstand anywhere from 400,000 to 1,000,000 cycles, a cycle being defined as including all processing steps which produce a copy.

The resistivity of the dielectric layer 26 shall be at least $10^{14}$ ohm-centimeters and have a thickness in the range of 0.4 to 0.6 mils, preferably about 0.5 mils.

The following materials have demonstrated their utility as a suitable dielectric layer 26. The term dielectric is intended to be synonymous with the broader term insulator.

Polystyrene:
PS-3 Manufactured by Dow Chemical Company;
Epoxy Resin:
Manufactured by Shell Oil Company;
Polyester Resins:
Vitel P.E. 222
Vitel P.E 307
Vitel P.E. 200
All "VITEL" resins manufactured by Goodyear Tire & Rubber
"MYLAR"
Dupont 46956
Dupont 46950
All "DuPont" resins manufactured by I. E. du Pont de Nemours.

Continuing the description of FIG. 2, the IGM 22 is fabricated by forming a conductive drum or cylinder 24 and applying to the surface the resilient layer 25.

The dielectric layer is prepared by dissolving 20 parts by weight of Vitel PE-200 polyester in 80 parts by weight of a solvent mixture, the solvent mixture containing 80 parts methyl ethyl ketone and 20 parts by weight toluene. The polyester solvent solution is applied by conventional coating techniques such as wire-wound rods, meniscus coaters, spray coating and drainage techniques. In the instant example a wire wound rod #80 applies the solution to the resilient layer 25 while it is in a flat condition. The wire wound rod applies sufficient solution to provide a coating thickness when dry of about 0.5 mils. The thickness of the dielectric layer is important and in the circumstance that the dielectric layer exceeds 0.8 mils, it will decrease the retention time of the charged particles on the surface.

The dry thickness of the dielectric layer 26 may be controlled by varying the percentage of solids in the solvent solution. For example, by reducing the solids from 20 to 10 parts and increasing the solvent content to 90 parts a thinner dry thickness is attained.

After the solvent solution is applied to the resilient layer, it is forced air dried for 2 hours at 100° F. The coated resilient layer is then applied to the conductive drum using a conventional rubber cement to integrate the layers 25 and 26 with the conductive drum 24.

It should be pointed out that the success of the multifarious duplicator of this invention depends on the construction of the IGM. It will be appreciated that the IGM is imparted a charge image pattern which is converted to a material image and then transferred to a receiving sheet. The quality of the reproduction created on the receiving sheet or impression paper is controlled by the IGM. If the dielectric properties are such that the charge pattern is not sustained on the surface 26, or the surface is vulnerable to very rapid abrasion, or the transfer of the material image is made without the benefit of the resiliency of layer 25, an unsatisfactory reproduction will occur. The resiliency of the layer 25 as well as the other physical properties of the layer 26 are significant in producing high quality transfers to plain paper.

The operation of the IGM 22 in the environment of the apparatus 20 results in the creation of an image medium 100 on the surface of the dielectric layer 26. As described earlier in connection with FIG. 1, the dielectric layer 26 is imparted a charge pattern in accordance with the graphic subject matter appearing on the original 48.

The charge pattern is developed into a base image 102 by the toning unit 80, which is fused onto the surface by activating station 76. This results in an ink receptive image base 102 to which is applied a transferrable ink image 104 at the station 72. The image medium 100 is comprised of a base image 102 and/or a transferrable image 104.

The ink-laden image medium 100 is caused to move through the transfer station in synchronization with a sheet of plain impression paper 30 at which the material image is transferred from the IGM 22 to the paper 30.

As the impression cylinder 36 comes together with the IGM 22 at the transfer station 28, the transfer of the ink image 104 occurs under conditions where the layer 25 yields and conforms under contact pressure from the impression cylinder effecting a very uniform and substantially complete transfer of the ink image.

In the circumstance that the image to be transferred is an unfused toner powder image, the resiliency of the layer 25 serves to preserve the integrity of the powder image to effect a complete uniform transfer resulting in a suitably dense reproduction.

It is important to appreciate that the success of the dielectric medium and the IGM generally depends on the compliancy of at least one of the surfaces making contact at the transfer station 28.

Figure 3:
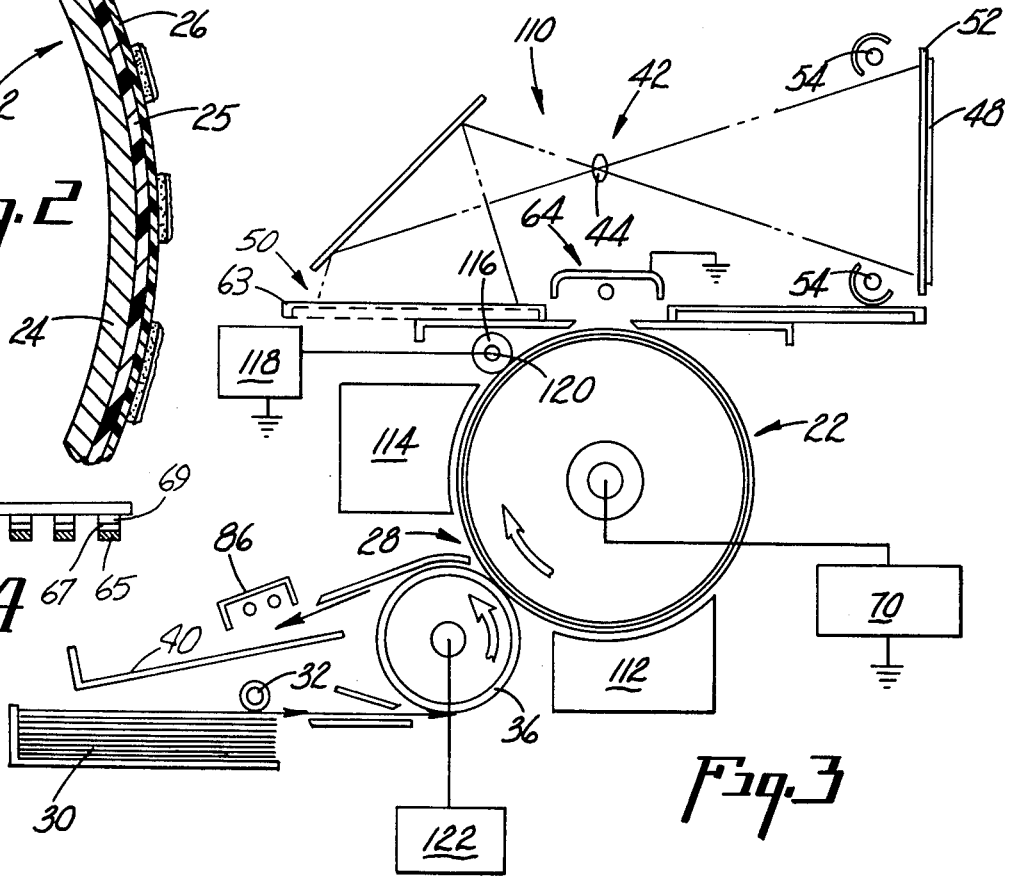
FIG. 3 is a schematic representation of another embodiment of the duplicating apparatus of the invention.

Referring now to FIG. 3, there is shown a duplicating apparatus which represents another mode of practicing the invention and is identified generally as 110. The duplicator 110 is equipped with an optical imaging system 42, similar in construction to the optical system shown and described in connection with FIG. 1. The duplicating apparatus of FIG. 3 is adapted to have created on the surface of the IGM 22 a charge distribution pattern in the same manner as set forth in the description of the apparatus 20. In describing the first cycle of the duplicator 110, the charge distribution system is converted into a material or visible image by the application of electroscopic toner powder from the developing station 112. As the IGM 22 containing the developed material image thereon moves into the transfer station 28, there is fed by the friction feed wheel 32 in synchronization, a sheet of plain paper or impression paper 30 into the nip between the impression cylinder 36 and the resilient layer 25 covered with the dielectric layer 26.

To facilitate the transfer of the powder image from dielectric layer 26 the transfer roller is connected to a high voltage source 122 creating the necessary electrical field between the conductive layer 24 and the conductive core of the transfer roller 36. In place of the electrical field a corona transfer electrode may be utilized.

With the powder image having been completely transferred to the surface of the plain paper 30, it moves along a path which advances the sheet into the receiving tray 40 equipped with an infra-red fusing device 86 which causes the loose powder on the surface to coalesce and be permanently bonded to the paper surface. Upon further rotation of the IGM 22, it moves past a cleaning station 114 where any residual untransferred electroscopic powder is removed by a suitable brushing technique and collected at the cleaning station.

Prior to the image generating medium moving into the next cycle, any residual electrostatic charge remaining on the surface is cleared by charges applied from the discharge roll 116. The discharge roll is connected to a power supply 118 and typically applies a potential to the conductive core 120 in the range of 300 to 3,000 volts of polarity opposite to the polarity of the residual charges to be removed.

As the IGM moves out from the influence of the discharge roller 116, its surface is in condition for accepting another charge distribution system from the optical system 42 by again repeating the steps of applying developer powder, transfer, cleaning and discharge of the charge distribution pattern.

The differences between the duplicating apparatus of FIG. 3 and FIG. 1 resides in the absence of the lithographic inking system and in its place the dry electroscopic powder is utilized to develop the charge distribution system on the surface of the dielectric layer 26 which is then transferred to the copy sheet. The apparatus of FIG. 3 is somewhat simpler in its operations and construction obviating the need for elaborate inking and fusing systems required in the apparatus of FIG. 1.

An important feature of the duplicator 110 is its ability to sustain the charge distribution pattern on the surface of the IGM 22 indefinitely thereby permitting the elimination of the cleaning and discharging steps after the first cycle. By merely redusting the image at station 112 a new transferrable material image is produced. This gives rise to a high output machine capable of making many hundreds of reproductions from the existing charge distribution system on the surface of the dielectric medium 26.

In the circumstance that a new graphic original is introduced on the surface of the transparent platen 52, so that new graphic subject matter is to be reproduced, it will then be necessary to clean any residual toner and to erase or otherwise neutralize any residual charges on the surface of the IGM.

While the description and operation of the invention has been described in the environment of certain machine configurations, it will be appreciated that the use of photoconductive screens in combination with the IGM provide a wide range of techniques for constructing high-speed multifarious duplicators. It is contemplated that the combination would permit various optical arrangements, not only the slit scan type of systems described in connection with FIG. 1 and 3, but also full frame exposures, creating thereon a charge distribution system which would then permit utilizing such a modulator to project gas ions onto the IGM. Photoconductive screens have been constructed which permit setting the modulators in a flat planar condition so as to form an exposure plane to receive the full frame image and subsequently modifying the screen to a curvilinear shape conforming to the radius of curvature of the IGM. Ion projection is accomplished by moving the projection electrode along the curved surface projecting the charged particles onto the dielectric surface.

In the circumstance that a memory screen is employed of the type which has been referred to earlier in the description and which has been fully described in U.S. Pat. application Ser. No. 423,883 filed in the name of Blades et al., and assigned to the same assignee as the instant invention, the duplicator successfully combines the IGM with the memory modulator to make possible a number of imaging techniques. Such a three layered memory screen is imparted a charge distribution system by simultaneously applying a DC charge with electromagnetic radiation, next applying an AC corona and simultaneously projecting a pattern of light and shadow to create a charge pattern and a final step of flood illumination. The IGM may be imparted the charge distribution system, as described in connection with FIG. 1 and during the successive cycles dust the charge distribution system with electroscopic toner particles producing a material image which is then transferred to plain paper. The cycle is repeated without having to clean, erase or reimage the system.

While preferred forms and arrangements have been shown in illustrating the invention, it will be understood that variations may be made in the embodiments disclosed herein without departure from the contemplated scope of the invention as defined in the appended claims.

What is claimed is:

1. In a process for making reproductions of a graphic original on plain paper through the use of a foraminated image storing device in cooperation with an image generating medium, the steps comprising:

imparting a charge distribution system on the surface of said image storing device corresponding to the intelligence on said graphic original, said charge distribution system causing said device to selectively transmit charged particles therethrough, directing charged particles against said image device;

collecting the charged particles transmitted through said device onto said image generating medium to form a charge pattern corresponding to the intelligence on said graphic original, said image generating medium being in the form of a metal cylinder, overcoated with a first compliant layer and a second dielectric layer, said second layer having a thickness of 0.4 to 0.6 mils and a resistivity of at least $10^{14}$ ohm-centimeters;

converting said charge pattern into a transferrable material image;

feeding said plain paper into pressure contact with said image generating medium to transfer said material image thereto.

2. The process as set forth in claim 1 wherein the steps of imparting said charge distribution system includes the process of:

a. simultaneously applying a DC corona charge and electromagnetic radiation, b. simultaneously applying an AC corona charge and a pattern of light and shadow, c. flood illumination of the surface.

3. The process as set forth in claim 1 wherein said image storing device comprising a photoconductive layer sandwiched between a metal screen and a transparent insulating layer.

4. The process as set forth in claim 1 wherein the step of converting said charge pattern is one of applying electroscopic powder which is attracted to the pattern and heat fusing the particles to the surface of the image generating medium.

5. The process as set forth in claim 1 wherein the dielectric layer of said image generating medium is treated with a polysiloxane compound to render the surface ink repellent.

* * * * *

UNITED STATES PATENT AND TRADEMARK OFFICE

CERTIFICATE OF CORRECTION

PATENT NO. : 4,047,946

DATED : September 13, 1977

INVENTOR(S) : George Thomas Croft

It is certified that error appears in the above-identified patent and that said Letters Patent are hereby corrected as shown below:

The drawing appearing on the Abstract page of the printed patent is incorrect and should be replaced with one of the Figures appearing on the drawing page of the printed patent. Column 2, line 5, "advantages" should read --disadvantages--. Claim 3, line 2, "comprising" should read --comprises--.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*